US006460946B1

(12) United States Patent
Beukema

(10) Patent No.: US 6,460,946 B1
(45) Date of Patent: Oct. 8, 2002

(54) OFFICE FURNITURE HAVING AN ADJUSTABLE SHELF ARRANGEMENT

(75) Inventor: Steven J. Beukema, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/493,564

(22) Filed: Jan. 28, 2000

(51) Int. Cl.[7] ..... A47B 27/00

(52) U.S. Cl. ..... 312/196; 211/134; 248/231.91; 108/152

(58) Field of Search ..... 211/153, 90.01, 211/90.02, 135; 248/220.31, 220.41, 220.42, 222.14, 231.91, 217.3; 108/152, 108; 312/196; 52/36.1, 36.5

(56) References Cited

U.S. PATENT DOCUMENTS 2,016,194 A * 10/1935 Fredin ..... 108/108
2,636,224 A * 4/1953 Murdoch et al. ..... 52/36.1
5,379,976 A * 1/1995 DeGirolamo ..... 248/221.2
5,833,083 A * 11/1998 Miller ..... 211/134
D414,353 S 9/1999 Clark et al.

FOREIGN PATENT DOCUMENTS

GB 2227652 A * 8/1990

* cited by examiner

*Primary Examiner*—Lanna Mai
*Assistant Examiner*—Jerry A. Anderson

(57) ABSTRACT

A readily reconfigurable shelf arrangement includes a support panel supported on a furniture component wherein the support panel has a plurality of rows and columns of shelf connectors to which individual shelves are connected. The pattern of shelf connectors defines different lateral and elevational positions in which the shelves may be connected. The individual shelves include removable support pegs which are secured to and project outwardly of the shelf connectors and a fabric shelf section which is suspended from the support pegs.

20 Claims, 5 Drawing Sheets

OFFICE FURNITURE HAVING AN ADJUSTABLE SHELF ARRANGEMENT

FIELD OF THE INVENTION

The invention relates to an adjustable shelf arrangement, for example, for a furniture system.

BACKGROUND OF THE INVENTION

Conventional office furniture arrangements typically include worksurfaces as well as shelf arrangements associated with the worksurface. Such shelf arrangements may be fixed shelves or cabinets. However, these fixed arrangements provide limited flexibility in modifying the shelf structure to accommodate the specific requirements of a user.

It also is known to provide ladder-like support racks on which shelves may be fixed. Support racks of this type typically permit adjustment of the height of the shelf but may only provide for limited lateral adjustment of the shelf, if at all.

In view of the foregoing, it is an object of the invention to provide a shelf arrangement which can be more readily reconfigured to adjust the elevational and lateral position of a shelf.

The invention relates to an improved shelf arrangement which includes a support panel having a plurality of rows and columns of shelf connectors to which individual shelves are connected. The shelf connectors preferably are provided along the entire lateral width of a worksurface. While a user typically works in the work area defined by the worksurface, the pattern of shelf connectors thereby defines different lateral and elevational positions in which the shelves may be positioned adjacent to the work area. This allows a user to position the shelves according to the particular requirements of the user.

Other objects and purposes, and variations thereof, will be apparent upon reading the following specification and inspecting the accompanying drawings.

Figure 1:
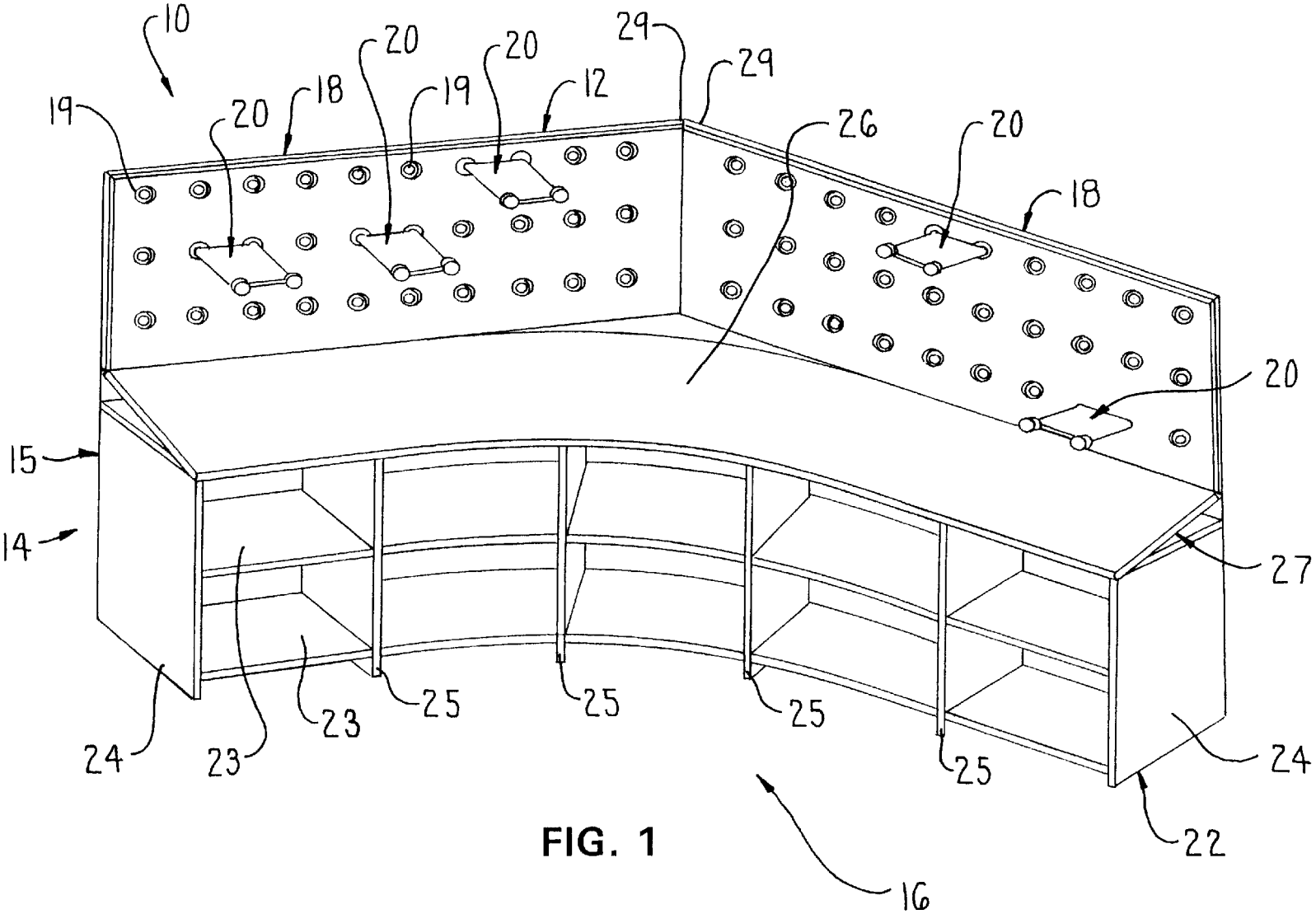
FIG. 1 is a perspective view of an improved furniture system having an adjustable shelf arrangement.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Referring to FIG. 1, the invention relates to a furniture system 10 having an adjustable shelf arrangement 12. The adjustable shelf arrangement 12, as illustrated, is mounted to a furniture component 14 such as a desk unit 15.

Generally, the shelf arrangement 12 includes one or more vertically enlarged support panels 18 which are supported, for example, on the furniture component 14. Each support panel 18 includes a pattern of shelf connectors, i.e. connector parts, 19 wherein the shelf arrangement 12 includes at least one shelf unit 20 which can be selectively mounted to the shelf connectors 19 in any desirable position. Each shelf unit 20 may be adjusted laterally and vertically to any desired position depending upon the needs of a user.

More particularly, the furniture component 14 on which the shelf arrangement 12 is mounted may have a variety of constructions. In the illustrated embodiment, the furniture component 14 is a desk unit 15 which is positioned in a workstation area 16. During typical use, this workstation area 16 may include additional furniture components (not illustrated) such as storage cabinets, wall panels or the like, and may also include various pieces of office equipment such as computers.

Referring to FIG. 1, the desk unit 15 includes a base 22 which defines a plurality of vertically spaced apart shelves 23. The shelves 23 are connected to upstanding end panels 24 and interior panels 25 for storage of articles therein.

The desk unit 15 further includes an upward-facing work surface 27 which is supported on the base 22 and defines a horizontally enlarged work area 26 on which a user typically works. In this upward facing work area 26, the user may place various articles such as documents, booklets, staplers and the like. In the illustrated desk unit 15, the work surface 27 also is inclined and has an arcuate shape which generally defines a right angle when viewed from above so that the work area 26 is L-shaped.

Each section of the desk unit 15 supports one of the support panels 18 thereon wherein each support panel 18 projects upwardly in a substantially vertical orientation. The support panels 18 have adjacent ends 29 which abut against each other generally at a right angle so that a user of the desk unit 15 can utilize either of the support panels 18. In such an arrangement, the support panel 18 also serves to visually and functionally separate one workstation 16 from another, or when placed on an existing wall surface, may serve as a cover panel therefore.

Alternatively, the support panels 18 may be used separately of each other. For example, a single support panel 18 may be supported on a conventional rectangular desk unit (not illustrated), a file storage unit or even on a movable base.

In further variations, the individual support panels 18 also may be supported on other types of furniture components 14 such as being suspended on the front face of conventional space-dividing wall panels. On such wall panels, the support panels 18 would have support brackets which removably connect the support panel 18 to one or more wall panels in facing relation therewith. If desired, a conventional work surface may also be provided on the wall panel directly below or adjacent to the support panel 18 so that the shelf units 20 are located directly adjacent to a users work area.

In conventional wall panels, removable cover pads also are provided. Thus, in a further variation, the support panels 18 of the invention may be provided with wall panel connector clips to serve as the cover pads for the wall panel.

Figure 2:
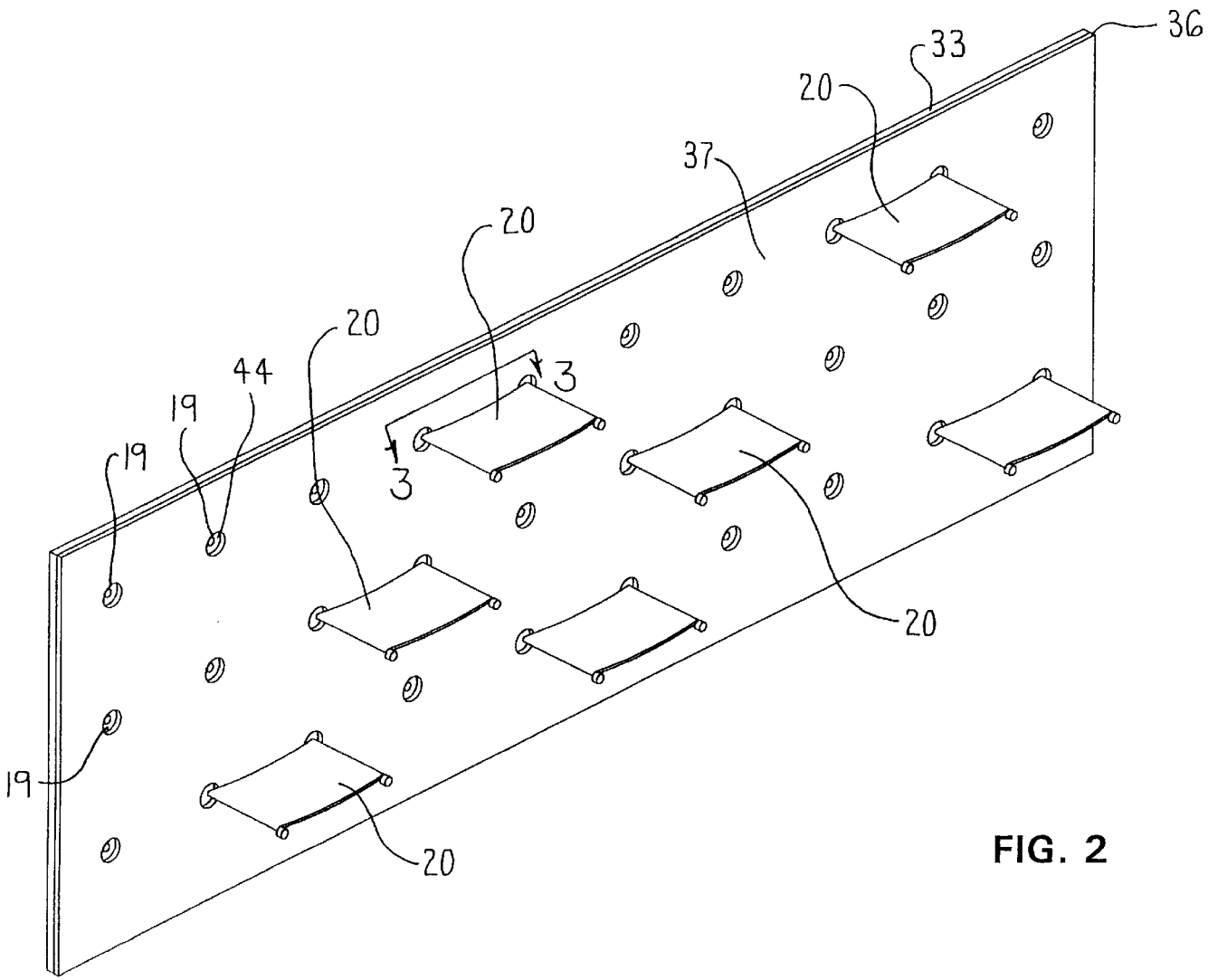
FIG. 2 is perspective view of one section of the shelf arrangement.
Figure 3:
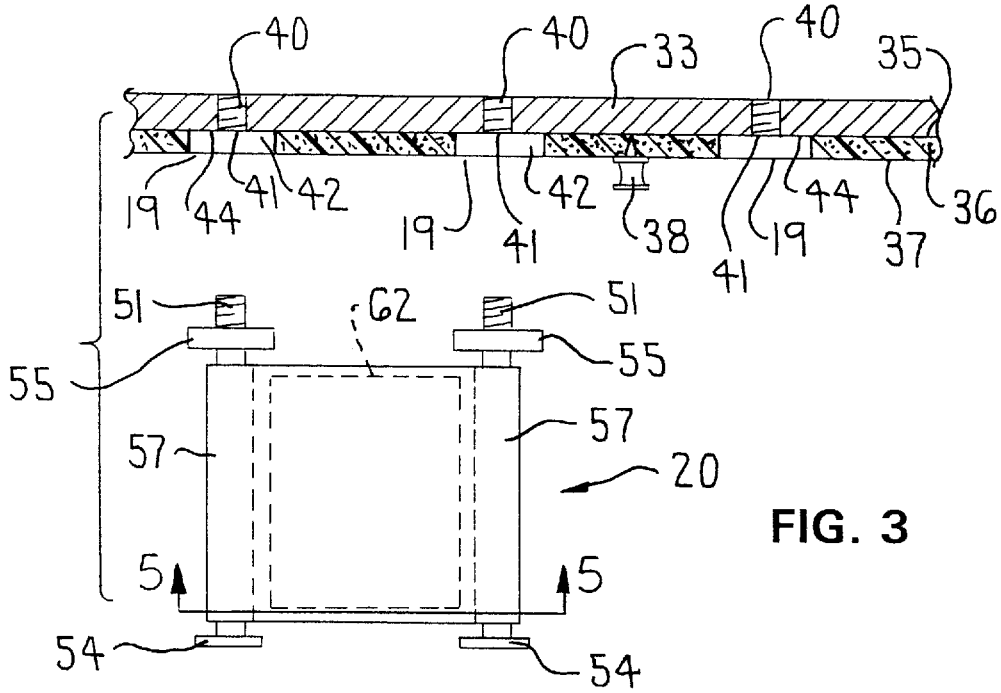
FIG. 3 is a partial plan view in cross-section as taken along line 3—3 of FIG. 2.
Figure 4:
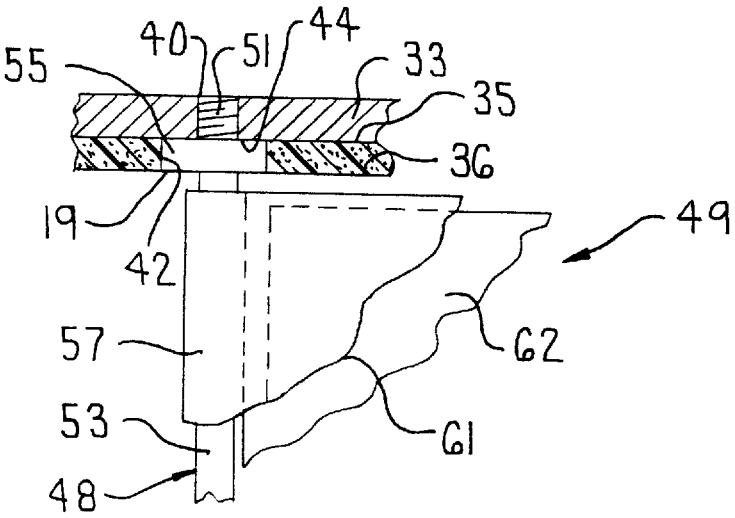
FIG. 4 is an enlarged partial plan view in cross-section of a connection between a shelf and a support panel.

More particularly with respect to the shelf arrangement 12, each support panel 18 has a rectangular substantially planar shape as seen in FIGS. 2–4. The support panel 18 is formed of a rigid substrate or backing panel 33. This backing panel 33 is formed of plywood or another wood material although other suitable rigid materials may be used.

A front face 35 of the backing panel 33 includes an outer layer or cover material 36 attached thereto in facing relation. The outer layer 36 has a rectangular shape which corresponds to the shape of the backing panel 33, and is secured thereto preferably by an adhesive.

The outer layer 36 defines an aesthetically pleasing finished surface 37 for the support panel 18 and is formed of a tackable material to permit mounting of a push pin 38 (FIG. 3) thereto. Suitable materials for the layer 36 include tackable plastic or foam materials. Typically, the backing panel 33 is approximately 0.75 inches while the tackable outer layer 36 is approximately 0.50 inches.

In order to support the shelf units 20 thereon, the support panel 18 includes a pattern of shelf connectors 19 wherein the shelf connectors 19 are aligned in rows and columns. While three rows and ten columns of shelf connectors 19 are provided, it also will be understood that any combination or pattern of shelf connectors 19 may be provided. The rows and columns are vertically and horizontally spaced apart at uniform distances. Preferably, the vertical and horizontal spacing is substantially equal.

Referring to FIGS. 3 and 4, each shelf connector 19 is defined by a threaded bore 40 which projects horizontally into the backing panel 33. Each bore 40 includes an outer open end 41 which opens horizontally through the front face 35 of the backing panel 33.

Where the backing panel 33 is formed of a wood material, the threaded bore 40 is defined by a metal insert which is embedded into the wood material of the backing panel 33. However, if the backing panel 33 is formed of another rigid material such as metal or plastic having sufficient rigidity to support the shelf units 20, the threads of the bore 40 may be formed directly within the material of the backing panel 33 without the use of an insert.

Each shelf connector 19 is further defined by circular cutouts 42 which are formed in the outer layer 36 and are coaxially aligned with the corresponding threaded bores 40. Each of the cutouts 42 has a greater diameter than the corresponding bore 40 to expose an annular section 44 of the front panel face 35.

Generally, with respect to the shelf units 20, each shelf unit 20 (FIGS. 3–5) includes at least a pair of support pegs or members 48 wherein each support peg 48 is adapted to be connected to a corresponding shelf connector 19. Each pair of support pegs 48 is laterally spaced apart and supports a shelf 49 thereon.

More particularly, each support peg 48 includes a threaded shank 51 at an inner end thereof wherein the shank 51 is threadedly engaged with a corresponding one of the bores 40. The threaded shank allows the peg 48 to be secured to any one of the various shelf connectors 19 wherein the peg 48 projects outwardly therefrom in cantilevered relation.

The outer end of the support peg 48 includes a horizontally elongate support section 53 and an outer collar 54 at the outer distal end of the support section 53. The collar 54 has an oval shape as illustrated in phantom outline in FIG. 5. The oval shape is more easily gripped to facilitate threading of the shank 51 into corresponding bore 40.

The peg 48 further includes an inner plate 55 which separates the shank 51 from the support section 53. The plate 55 has a diameter which corresponds to the cutouts 42 of the support panel 18 and defines a stop which limits insertion of the shank 51 into the bore 40. The plate 55 furthermore is enlarged to lie flat against the substrate 33 to accommodate some of the loads on the peg 48 and maintain the peg 48 substantially horizontal, particularly where there is some play between the threads of the shank 51 and the bore 40.

Also, the collar 54 and plate 55 have widths which are greater than the support section 53 which helps prevent unwanted removal of the shelf 49 therefrom as discussed in further detail herein.

With respect to the shelf 49, the shelf 49 is formed of a flexible fabric material having hems 57 along the opposite side edges thereof. Each hem 57 is open on the opposite ends thereof to receive a peg 48 longitudinally therethrough. As a result, the opposite side edges of each shelf 49 are supported by a corresponding pair of pegs 48.

To receive the peg 48, the hem 57 is sufficiently large so that the end collar 54 fits therethrough. As such, after assembly as seen in FIG. 5, an outer portion of the hem 57 wraps about the peg support section 53 while an inner portion 60 extends downwardly therefrom.

After insertion, the hem 57 is confined between the collar 54 and plate 55 to prevent the shelf 49 from moving forwardly and inadvertently sliding off of the pegs 48. When assembled, a central section 59 of the shelf 49 spans the lateral distance between the hems 57 and defines an upward facing storage area 58 on which articles may be stored. While the central section 59 has a lateral width corresponding to the distance between a laterally adjacent pair of connectors 19, the lateral width may be formed in multiples of this distance.

Figure 5:
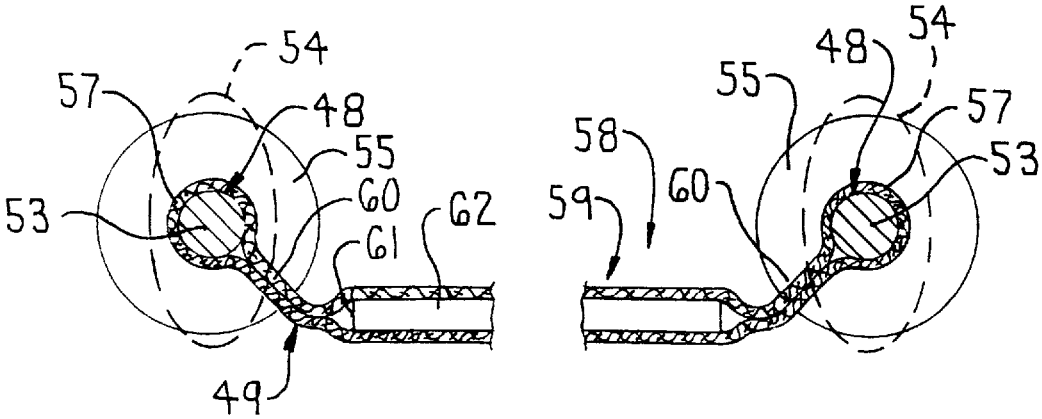
FIG. 5 is a front view in cross-section of the shelf as taken along line 5—5 of FIG. 3.

Referring to FIG. 5, the lateral dimension of the shelf 49 preferably is larger than the lateral distance between the pegs 48 such that the central section 59 of the shelf is at an elevation lower than the pegs 48. As a result, the inner portions 60 of the hems 57 extend downwardly and effectively defined side walls of the shelf 49. This also permits the shelf 49 to be removed without having to remove the pegs 48 from the support panel 18.

Alternatively, it is understood that the lateral dimension of the shelf 49 also can be substantially equal to the lateral distance between the pegs 48 so that the shelf 49 and pegs 48 are substantially coplanar. Since the pegs 48 are freely rotatable in the hems 57, the shelf 49 and pegs 48 in this variation can be first assembled and then the pegs 48 installed on the support panel 18 by rotation of the pegs 48.

To maintain the central section 59 of the shelf 49 substantially planar in the illustrated embodiment, the shelf 49 also is formed with a double layer of fabric material which forms an interior pocket 61 (FIGS. 4 and 5). The pocket 61 opens rearwardly towards the support panel 18 and receives a rigid rectangular insert 62 therein. The insert 62 preferably is formed of plastic. If necessary, the rear edges of the pocket 61 may be closed by a suitable closure such as Velcro although this is not required since the proximity of the support panel 18 in use prevents removal of the insert 62.

Referring to FIG. 2, the arrangement of the shelf connectors 19 permits each shelf unit 20 to be positioned at any desired location. For example, the shelf unit 20 may be selectively mounted on the support panel 18 at a desired elevation defined by one of the horizontal rows of bores 40 and at a selected lateral position along the row. Since the shelf connectors 19 are located at uniform distances, the shelf units 20 may be positioned one above the other in vertical alignment, and the shelf units 20 also may be horizontally offset from each other (as seen by the three leftward shelf units 20 in FIG. 2).

Figure 6:
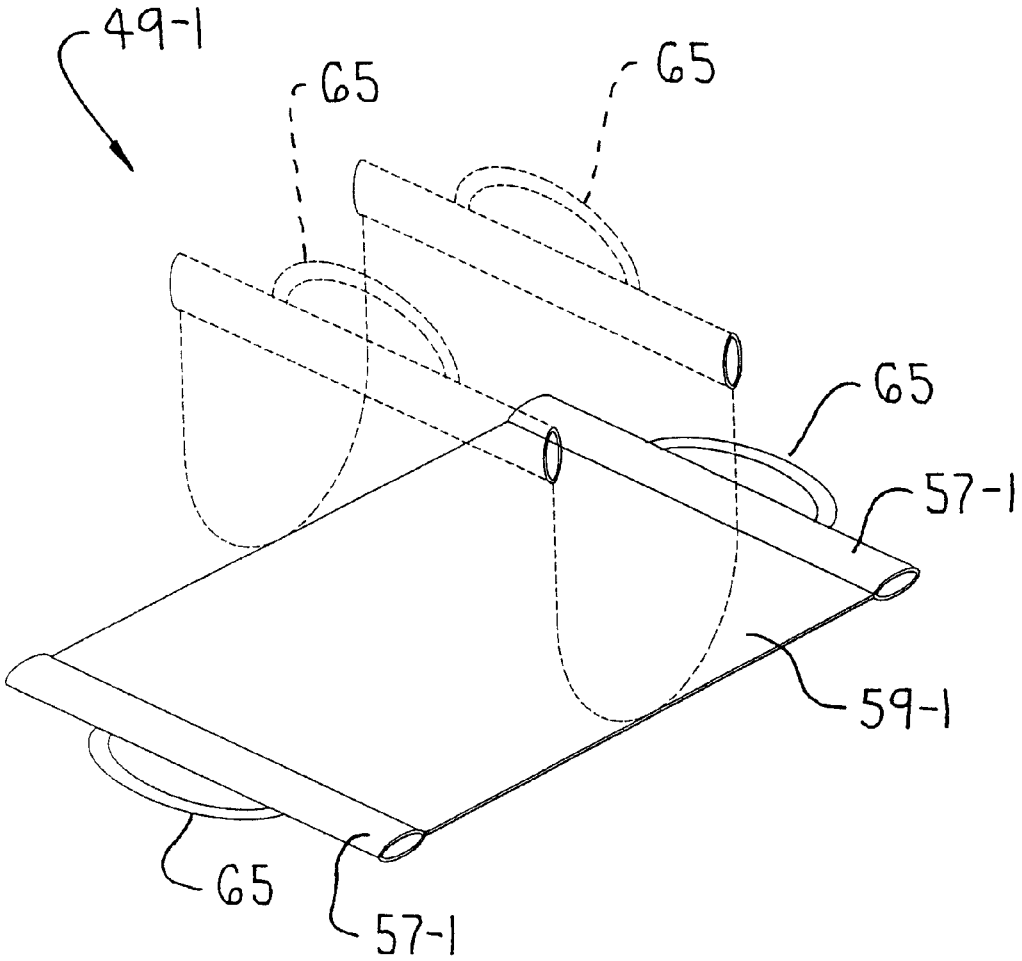
FIG. 6 is a perspective view of an alternative embodiment for the shelf having handles.

In another alternate embodiment, the shelf 49-1 of FIG. 6 is formed with handles 65 which are connected to the hems 57-1. The shelf 49-1 has a construction identical to the shelf 49 except for the addition of the handles 65. Therefore, upon removal of the shelf 49-1 from the pegs 48, the handles 65 allow the shelf 49-1 to be carried, and, where the insert 62 is removed, to be folded up as indicated in phantom outline. As such, the center shelf section 59-1 is able to store articles therein, which articles can be carried from one area to another by the handles 65.

Figure 7:
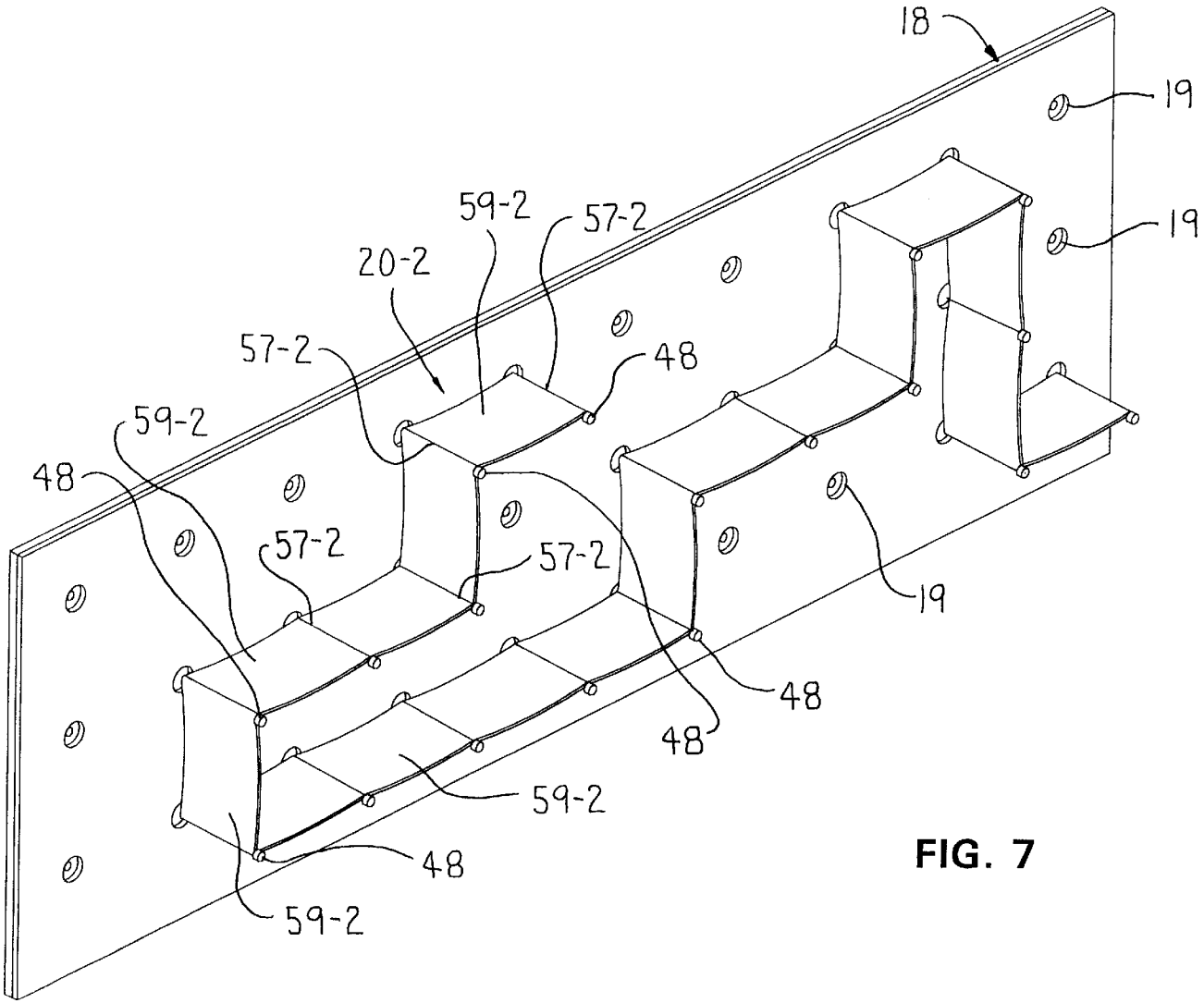
FIG. 7 is a perspective view of a further embodiment for the shelf arrangement.

In a further alternate embodiment of FIG. 7, a shelf unit 20-2 may be provided wherein the shelf is formed of a continuous length of multiple shelves 49-2. In particular, the shelf unit 20-2 preferably is formed of a length of fabric material which forms a plurality of laterally spaced apart hems 57-2 which receive the pegs 48 therethrough. Each laterally adjacent pair of shelves 49-2 thereby is connected together by the intermediate hem 57-2 disposed therebetween.

The shelf unit 20-2 has a modular length defined by two or more shelves 49-2 and in the illustrated embodiment has a length corresponding to seventeen shelves. The pegs 48 are mounted one next to the other either horizontally or vertically so that the shelves 492 are oriented horizontally for supporting articles or vertically to transition vertically from one row to another and permit positioning of the shelves 49-2 at different elevations as seen in FIG. 7.

With the above-described shelf arrangement, the storage areas defined by the shelf units 20, 20-1 or 20-2 can be readily reconfigured next to the work area 26. This provides significant flexibility in adjusting the arrangement of the workstation 16 to accommodate the needs of a user.

More specifically, in use, the pegs 48 are first mounted on the support panel 18 and in particular, connected to laterally adjacent pairs of shelf connectors 19. Where a rigid support surface is desired, the insert 62 is inserted into the pocket 61. Thereafter, the associated shelf 20 is slid onto the pegs 48 and supported thereon.

If the user's needs change, one or more shelves 20 are removed from the support panel and the pegs 48 are repositioned vertically and/or horizontally.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A furniture arrangement comprising:

an upright support panel having a plurality of vertically spaced apart rows of connector parts; and at least one shelf unit comprising a shelf which defines an upward facing shelf surface and a pair of laterally spaced apart and elongate shelf supports between which said shelf extends, said shelf including elongate openings along respective lateral edges thereof and said shelf supports mounting enlarged collars on front free ends thereof, said shelf supports being engaged with respective connector parts for supporting said shelf on said support panel and being respectively disposed within said openings of said shelf such that said shelf is confined between said support panel and the respective collars to prevent inadvertent removal of said shelf from said shelf supports, said connector parts in each of said rows being laterally spaced apart at equal distances from one an other and said shelf supports being removably engaged with the respective connector parts such that said shelf unit may be repositioned between any laterally adjacent pair of said connector parts laterally along one of said rows or vertically to another of said rows.

2. The furniture arrangement according to claim 1 wherein said shelf is constructed of a flexible material which defines said elongate openings along respective lateral edges thereof.

3. The furniture arrangement according to claim 1, wherein said support panel includes a front face and said connector parts are accessible from said front face, said front face being defined by a tackable material.

4. The furniture arrangement according to claim 3, wherein said support panel includes a rigid substrate having said connector parts rigidly supported thereon, said tackable material overlying said substrate.

5. The furniture arrangement according to claim 1, wherein said shelf supports have rear sections which are rigidly engaged with respective connector parts and project forwardly from said support panel.

6. The furniture arrangement according to claim 5, wherein said shelf is removable from said shelf supports when said shelf supports are mounted on said support panel.

7. The furniture arrangement according to claim 6, wherein said shelf is a flexible fabric which is suspended from said support members.

8. The furniture arrangement according to claim 1, further including a worksurface which defines a work area, and said support panel projects upwardly above a rear edge of said worksurface and extends along a lateral width thereof, said shelf being accessible from a front side of said support panel to permit repositioning of articles between said worksurface and said shelf.

9. The furniture arrangement according to claim 8, wherein each laterally and vertically adjacent pair of connector parts are disposed at equal distances from one another and a width of each said shelf corresponds to the distance between any horizontally or vertically adjacent pair of said connector parts to permit repositioning of a said shelf between any adjacent pair of said connector parts and facilitate movement of articles between said work area and a storage area defined by said shelf.

10. The furniture arrangement of claim 1, wherein a plurality of said shelf units are provided and said shelves thereof are defined by a continuous length of flexible material defining a plurality of tubular connectors spaced uniformly along the length thereof and removably engaged with respective shelf supports, each said tubular connector defining a said opening therein such that each said shelf is disposed between an adjacent pair of said openings and each laterally adjacent pair of said shelves being joined together by a shared said tubular connector.

11. The furniture arrangement according to claim 10, wherein said connector parts are arranged on said support panel in a plurality of horizontal rows and vertical columns, said shelf supports being connected to said support panel either horizontally adjacent to each other or vertically adjacent to each other such that the respective shelf extends horizontally or vertically.

12. The furniture arrangement of claim 1, wherein said connector parts are threaded openings defined in said support panel, said shelf supports including rear ends which respectively threadingly engage within a pair of laterally adjacent threaded openings in said support panel and project forwardly therefrom.

13. A furniture arrangement comprising:

a generally vertically oriented support panel having rows and columns of connector parts wherein each horizontally and vertically adjacent pair of said connector parts are spaced uniform distances from each other; and a shelf system for defining one or more upward facing storage areas on said support panel, said shelf system including a pair of support pegs which are respectively removably engaged with a laterally adjacent pair of said connector parts, said support pegs projecting forwardly from said support panel in cantilevered relation therewith, said shelf system further including a shelf having flexible tubular portions which receive the respective support pegs therein and a generally planar stiffener panel disposed between said tubular portions, said shelf including a central section disposed between said tubular portions which defines an upward facing storage surface, said support pegs being removably engaged with said connector parts to permit repositioning of said shelf laterally along one of said rows or vertically to another of said rows between any adjacent pair of said connector parts.

14. The furniture arrangement according to claim 13, wherein each of said support pegs includes enlarged projections which are spaced apart and said tubular portion being confined therebetween to resist removal of said shelf from said support pegs.

15. The furniture arrangement according to claim 14, wherein each said support peg is rotatably engaged with the respective connector part and is rotatable relative to said tubular portion supported thereon.

16. The furniture arrangement according to claim 15, wherein each said support peg includes a threaded end part which is threadedly engaged with the respective connector part.

17. The furniture arrangement according to claim 13, wherein a plurality of said shelves are provided and each laterally adjacent pair of said shelves are joined together by a shared said tubular portion.

18. The furniture arrangement of claim 13 further including a worksurface, and said support panel projects upwardly above a rear edge of said worksurface and extends along a lateral width thereof.

19. The furniture arrangement according to claim 13, wherein said shelf is suspended downwardly of said support pegs such that said stiffener is disposed lower than said support pegs.

20. The furniture arrangement according to claim 13, wherein said shelf includes handles which are laterally spaced apart to permit folding and carrying of said shelf when said shelf is removed from said support pegs and said stiffener panel is removed from said shelf.

* * * * *

UNITED STATES PATENT AND TRADEMARK OFFICE

CERTIFICATE OF CORRECTION

PATENT NO. : 6,460,946 B1
DATED : October 8, 2002
INVENTOR(S) : Steven J. Beukema It is certified that error appears in the above-identified patent and that said Letters Patent is hereby corrected as shown below:

Column 6,
Line 14, change "material." to -- material which is capable of being punctured by a sharp-ended object such as a push pin. --

Signed and Sealed this

First Day of April, 2003

JAMES E. ROGAN
*Director of the United States Patent and Trademark Office*